US005888174A

United States Patent [19]

Schlee

[11] Patent Number: 5,888,174

[45] Date of Patent: Mar. 30, 1999

[54] HAND HELD RELAXATION/EXERCISE DEVICE

[76] Inventor: Emil Schlee, 40755 RCR #36, Steamboat Springs, Colo. 80487

[21] Appl. No.: 151,955

[22] Filed: Sep. 11, 1998

[51] Int. Cl.[6] ..... A63B 21/06; A63B 23/12

[52] U.S. Cl. ..... 482/44; 482/105; 482/110

[58] Field of Search ..... 482/44–46, 98, 482/105, 110, 132; 601/72, 74, 122, 124, 125, 126, 131, 132; 446/26, 236, 266

[56] References Cited

U.S. PATENT DOCUMENTS 3,672,093 6/1972 Meek ..... 482/110

FOREIGN PATENT DOCUMENTS 2661333 10/1991 France ..... 482/45

*Primary Examiner*—John Mulcahy
*Attorney, Agent, or Firm*—Edwin H. Crabtree; Ramon L. Pizarro; Donald W. Margolis

[57] ABSTRACT

A hand held relaxation/exercise device adapted for attachment to a back of a hand via strapping to fingers of the hand and wrist. The device includes a first conical shaped wheel having a first circular base with sloping sides extending upwardly to an apex. A strap connector is attached to a face of the first circular base. The strap connector includes finger strap slots for receiving finger straps therein and a flange for receiving a portion of a wrist strap. The finger straps and wrist strap are used for securing the device to the fingers of the hand and the wrist during an exercise period. The first conical shaped wheel includes a first pivot shaft disposed through the center of the first wheel and rotatably mounted on a first ball bearing mounted inside the first circular base. A second conical shape wheel includes a second pivot shaft disposed through the center of the second wheel and rotatably mounted on a second ball bearing mounted inside a second circular base. The second pivot shaft extends outwardly from an apex of the second wheel. The second pivot shaft is connected to one end of a 90 degree elbow. The first pivot shaft is connected on an opposite end of the elbow. Sloping sides of the second wheel engage the sloping sides of the first wheel and rotate thereon during the use of the device.

14 Claims, 3 Drawing Sheets

SHEET 1 OF 3

SHEET 2 OF 3

HAND HELD RELAXATION/EXERCISE DEVICE

BACKGROUND OF THE INVENTION (a) Field of the Invention

This invention relates to an exercise device and more particularly, but not by way of limitation, to a hand held relaxation and/or exercise device adapted for attachment to a back of a hand and secured to the fingers of the hand and the wrist.

(b) Discussion of Prior Art

Heretofore what makes occasional exercise difficult, for those who might have the time and the desire, is overcoming the everyday stiffness that restricts movement. Pushing through this lack of flexibility is painful at times. This can be discouraging and difficult to change. Lack of flexibility is rooted in lifelong habits of strain due to one's lifestyle wherein the muscles are actually stuck together in these patterns. Also, chronic stiffness may revolve around old injuries or a series of minor trauma that was never totally rehabilitated.

Few exercise methods today do anything to restore flexibility or energy. In fact, most popular practices are more involved in the pursuit of spending energy. Another common attitude mistakenly equates physical fitness with muscular development. More people pumping up at the gym are waking up with the same aches and pains realizing that more strength is not more energy. Conventional free weight exercise, designed to strengthen the upper body, typically involves raising or pushing a weight against the force of gravity. This most often requires the use of gripping muscles in the hands and arms which limit movement to isolated and rigid patterns. Also, conventional exercise machines follow specific patterns of directional resistance which are limited in range and often operate only in two dimensions. These types of movement are associated with archaic ideals of physical labor such as lifting, pushing, curling, pressing, etc. This approach to fitness and strength reinforces disproportionate strength and arbitrary alignment of the body's physical structure.

In U.S. Pat. No. 4,006,895 to DiLaurenzio, U.S. Pat. No. 5,358,463 to Fuentes and U.S. Pat. No. 4,982,950 to Petrosky three different types of hand held exercising device are described wherein wrist action is required by a user to move rotating members mounted thereon. Also, in U.S. Pat. No. 3,672,093 to Meek, Sr., U.S. Pat. No. 3,306,612 to Rosen and U.S. Pat. No. 3,533,185 three hand held toys are disclosed wherein wrist action is required for rotating weighted pendulums and rings.

None of the above mentioned prior art exercising devices and related toys disclose or teach the specific structure of the subject hand held relaxation/exercise device as described herein.

SUMMARY OF THE INVENTION

In view of the foregoing, it is a primary object of the subject relaxation/exercise device is to provide a hand held free-weight that engages the entire sphere of physical movement, by allowing the hand, fingers, wrist and forearm to flex, extend, pronate, or supinate freely while performing an exercise. This freedom of movement also facilitates lateral and medial rotations of the upper arms and shoulders during both abductive and adductive movement. Connecting the movement throughout the arms and shoulders extends the exercise into the neck, torso and eventually the entire body.

Another object of the invention is to guide the synchronous movement of the extremities and postural muscles while refining coordination and balance therein. Exercising with the device will not only lengthen and strengthen the muscle and connective tissue, but support the proper alignment of all the parts in relation to balance thereby enhancing flexibility and efficiency of the body's physical structure.

Yet another object of the relaxation/exercise device is that it's use can be exhilarating. The device provides instant access to a wide range of benefits from intense muscular to meditative. Anyone with a moment to relax can begin using the hand held device. Just turning the invention casually for a while can relieve stress. Doing a regular 15 to 30 minute exercise program can transform the body. Regularity and patience are the key to eventual advancement. After people get the "hang" of it, they can easily begin improvising and following what feels good to broaden and deepen the benefits. The relaxation/exercise device is playful therapeutic exploration.

Still another advantage of the invention is each unit is lightweight, compact and portable. The exercise technique of using the device is simple and can be performed at home or office, traveling, in front of a television and listening to music. The device also includes accessory weights which can be added for providing additional weight to the relaxation/exercise device.

A further object is until now only Eastern forms of exercise, such as Hatha Yoga and Tai Chi, practice a similar dynamic. These forms are difficult to learn properly and require a level of discipline that few people can afford. While this method of exercise is an excellent compliment to these traditional forms, the subject relaxation/exercise device amplifies sensory feedback in a way that can guide and support a similar discipline for an average fitness enthusiast.

The structure of the subject invention includes a first conical shaped wheel having a first circular base with sloping sides extending upwardly to an apex. A strap connector is attached to a face of the first circular base. The strap connector includes finger slots for receiving finger straps therein and a flange for receiving a portion of a wrist strap. The finger straps and wrist strap are used for securing the device to the fingers of the hand and the wrist during an exercise period. The first conical shaped wheel includes a first pivot shaft disposed through the center of the first wheel and rotatably mounted on a first ball bearing mounted inside the first circular base. A second conical shape wheel includes a second pivot shaft disposed through the center of the second wheel and rotatably mounted on a second ball bearing mounted inside a second circular base. The second pivot shaft extends outwardly from an apex of the second wheel. The second pivot shaft is connected to one end of a 90 degree elbow. The first pivot shaft is connected on an opposite end of the elbow. Sloping sides of the second wheel engage the sloping sides of the first wheel and rotate thereon during the use of the device.

These and other objects of the present invention will become apparent to those familiar with the different types of exercising devices when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
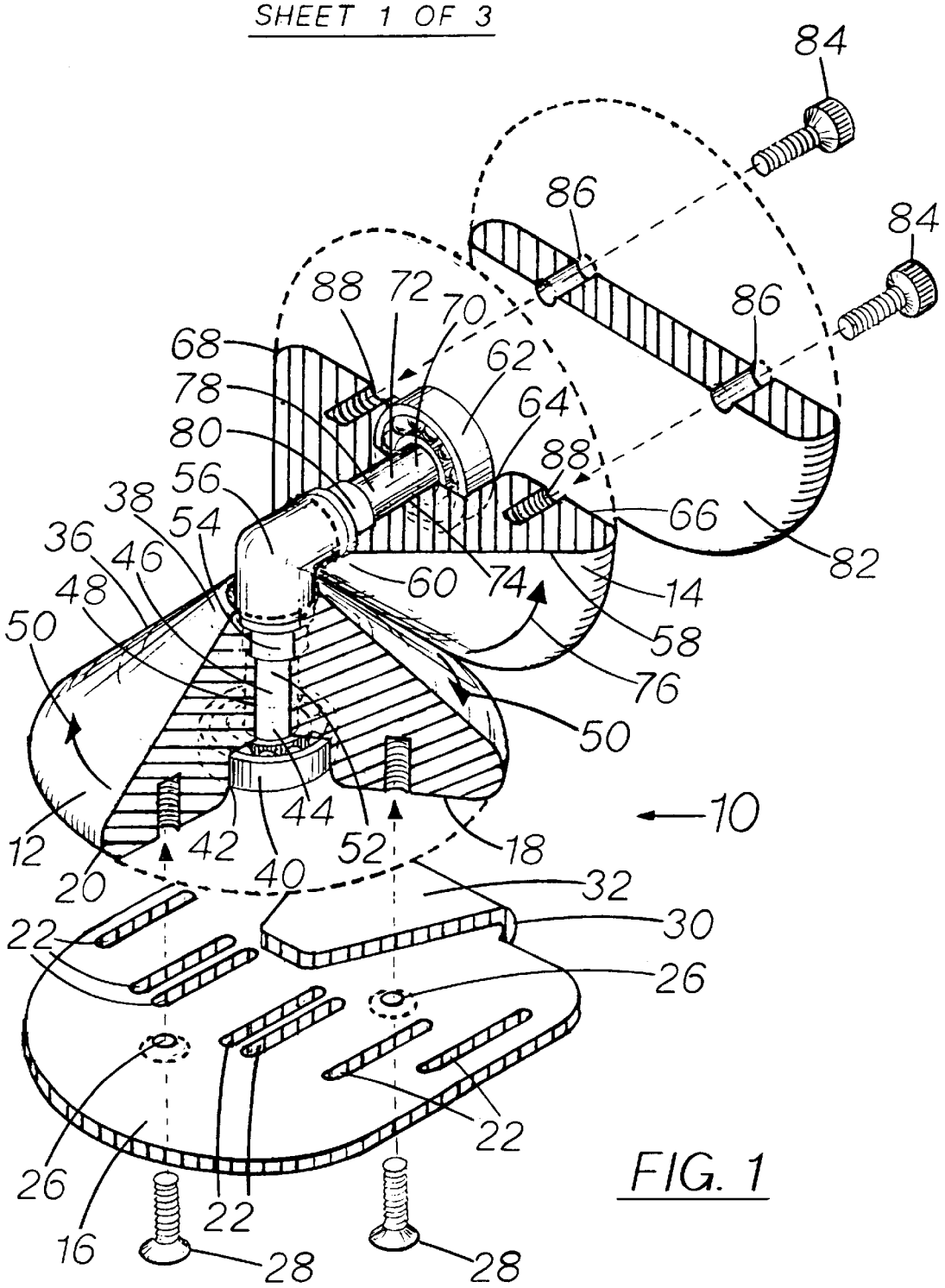
FIG. 1 is a perspective view of the hand held relaxation/exercise device with a strap connector positioned for attachment to a face of a first circular base of a first conical shaped wheel. Also, an accessory weight is positioned for attachment to a face of a second circular base of a second conical shaped wheel.

In FIG. 1, a perspective view of the subject hand held relaxation/exercise device is shown and having general reference numeral 10. Broadly the device 10 includes a first conical shaped wheel 12, a second conical shaped wheel 14 and a strap connector 16. The wheels 12 and 14 are made of metal and may be of various weights from 3 to 5 pounds or more depending on the desire, ability and experience of the user of the device 10. In this drawing, the strap connector 16 is positioned for attachment to a face 18 of a first circular base 20 of the first conical shaped wheel 12. Also, in this drawing a portion of the first and second wheels 12 and 14 have been cut away to expose internal components used in allowing the wheels to pivot and rotate on and against each other.

Figure 3:
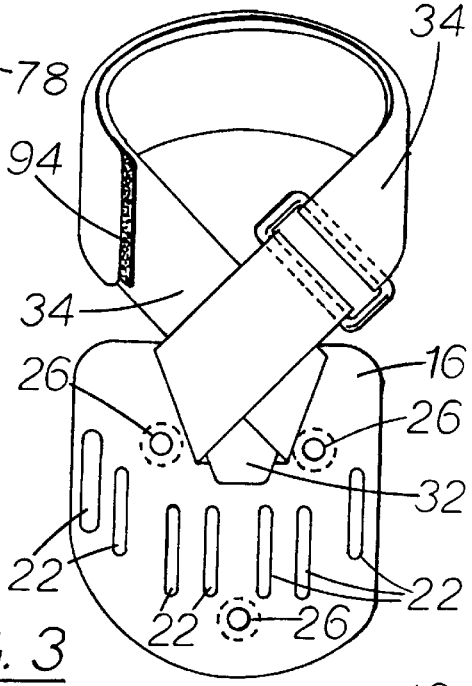
FIG. 3 is a top view of the strap connector and a wrist strap for the right hand. A portion of the wrist strap is shown attached to a wedge shaped flange which is part of the strap connector.
Figure 4:
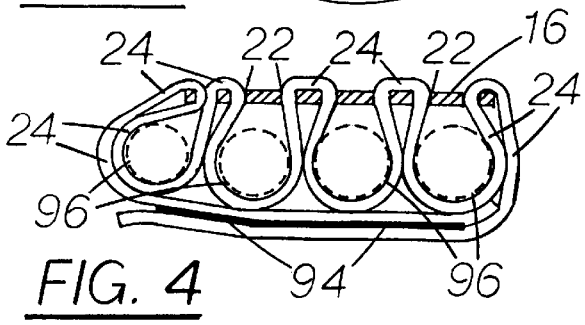
FIG. 4 is a side sectional view of a portion of the strap connector and finger straps. The finger straps are shown received through finger strap slots in the connector.

The strap connector 16 includes a plurality of finger strap slots 22 for receiving finger straps 24 therethrough. The finger straps 24 are shown in FIG. 4. The connector 16 also includes fasteners holes 26 for receiving fasteners, such as screws 28, for securing the strap connector 16 to the face 18. While screws 28 are shown in the drawings, it should be kept in mind that a variety of different types of fasteners can be used equally well. Also, the connector 16 includes an upwardly extending arm 30 connected to a wedge shaped flange 32. The flange 32 is disposed above and parallel to a plane of the connector 16. The flange 32 is used for receiving a portion of a wrist strap 34. The wrist strap 34 is shown in FIG. 3.

The first conical shaped wheel 12 includes upwardly sloping sides 36 which extend to a top or an apex 38 of the wheel 12. The sides 36 in the drawings slope upwardly at 45 degrees but it should be mentioned that the slope may be 30 degrees, 60 degrees or any other angle forming a conical shape and without departing from the scope and spirit of the invention. In this drawing, a portion of the wheel 12 has been cut away to expose a first roller bearing 40 received inside a cavity 42 in the center of the face 18. One end 44 of a first pivot shaft 46 is attached to the first roller bearing 40 with the first pivot shaft 46 extending upwardly through an opening 48 through the center of the first conical shaped wheel 12. The opening 48 extends from the face 18 to the apex 38. The first wheel 12 rotates freely around the pivot shaft 46 as indicated by arrows 50. In turn, the first pivot shaft 46 pivots freely on the first wheel 12. An opposite end 52 of the first pivot shaft 46 is received through a first bushing 54 and to a 90 degree elbow 56. The first bushing 54 is mounted in the apex 38 of the first wheel 12.

The second conical shaped wheel 14 also includes upwardly sloping sides 58 which extend to a top or an apex 60 of the second wheel 14. The sides 58 slope upwardly at 45 degrees and engage the corresponding sides 36 of the first wheel 12. Obviously, the slope of the sides of each wheel 12 and 14 may vary but they must correspond to each other for full engagement as the wheels 12 and 14 rotate during an exercise program. In this drawing, a portion of the second wheel 14 has been cut away to expose a second roller bearing 62 received inside a cavity 64 in the center of a face 66 of a second circular base 68 of the second wheel 14. One end 70 of a second pivot shaft 72 is attached to the second roller bearing 62 with the second pivot shaft 72 extending upwardly through an opening 74 through the center of the second conical shaped wheel 14. The opening 74 extends from the face 66 to the apex 60. The second wheel 14 rotates freely around the second pivot shaft 72 as indicated by arrows 76. Also, the second pivot shaft 72 pivots freely on the second wheel 14. An opposite end 78 of the second pivot shaft 72 is received through a second bushing 80 and secured to the 90 degree elbow 56. The second bushing 80 is mounted in the apex 60 of the second wheel 14. The elbow 56 attached to the first and second pivot shafts 46 and 72 allows the sloping sides 36 of the first wheel 12 to engage and freely rotate both clockwise and counterclockwise on the sloping sides 58 of the second wheel 14.

Also shown in FIG. 1 is a circular accessory weight 82 positioned for attachment to the face 66 of the second circular base 68 of the second wheel 14. The accessory weight 82 may be 1 or 2 pounds or more for providing additional weight to the device 10. The weight 82 is attached using screws 84 received through holes 86 in the weight 82 and tightened into threaded bores 88 in the face 66 of the second wheel 14. While the screws 84 are shown in the drawings, it can be appreciated that various types of fasteners can be used equally well including those which facilitate quick-release attachment/detachment. The weight 82 has a circumference which is substantially the same as the circumference of the second circular base 68 of the second wheel 14.

Figure 2:
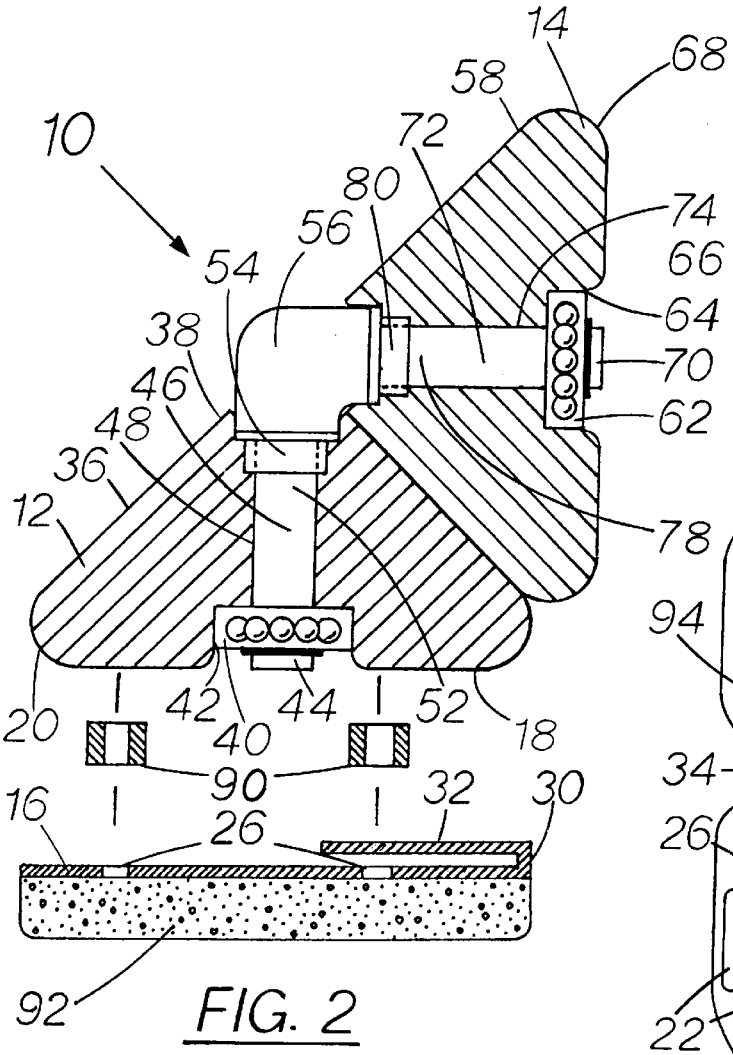
FIG. 2 is a side sectional view of the first and second conical wheels. The strap connector is shown positioned for attachment to the first conical wheel.

In FIG. 2, a side sectional view of the first and second conical wheels 12 and 14 and the strap connector 16 is illustrated. In this view, the strap connector 16 is shown with spacers 90. The spacers 90 are used to provide room between the top of the connector 16 and the face 18 of the first wheel 12 when a portion of the finger straps 24 and the wrist strap 34 are attached to the strap connector 16 as shown in FIGS. 3 and 4. Also, the strap connector 16 is shown with a sponge backing 92 for providing comfort when the fingers of the user's hand are received against the finger straps 24 and the connector.

In this drawing, the sloping sides 36 of the first wheel 12 are shown engaging the sloping sides 58 of the second wheel 14. Also shown is a side view of the 90 degree elbow 56 connected to the first and second roller bearings 40 and 62 via the first and second pivot shafts 46 and 72.

In FIG. 3, a top view of the strap connector 16 for the right hand is shown. In this view, a portion of the wrist strap 34 is shown attached to the wedge shaped flange 32. The wrist strap 34 may be of various lengths and is designed to wrap around a portion of the user's wrist and attach to itself using hook and loop fasteners 94 or any other similar types of fasteners. The wrist strap 34 is shown engaging a user's wrist in FIG. 5.

In FIG. 4, a side sectional view of a portion of the strap connector 16 is shown with finger straps 24 received through the finger strap slots 22 in the connector 16. Opposite ends of the finger straps 24 are shown connected together using hook and loop fasteners 94. In this drawing, dotted circular lines 96 are shown to represent the four fingers of the hand which are received in the loops formed using the finger straps 24.

Figure 5:
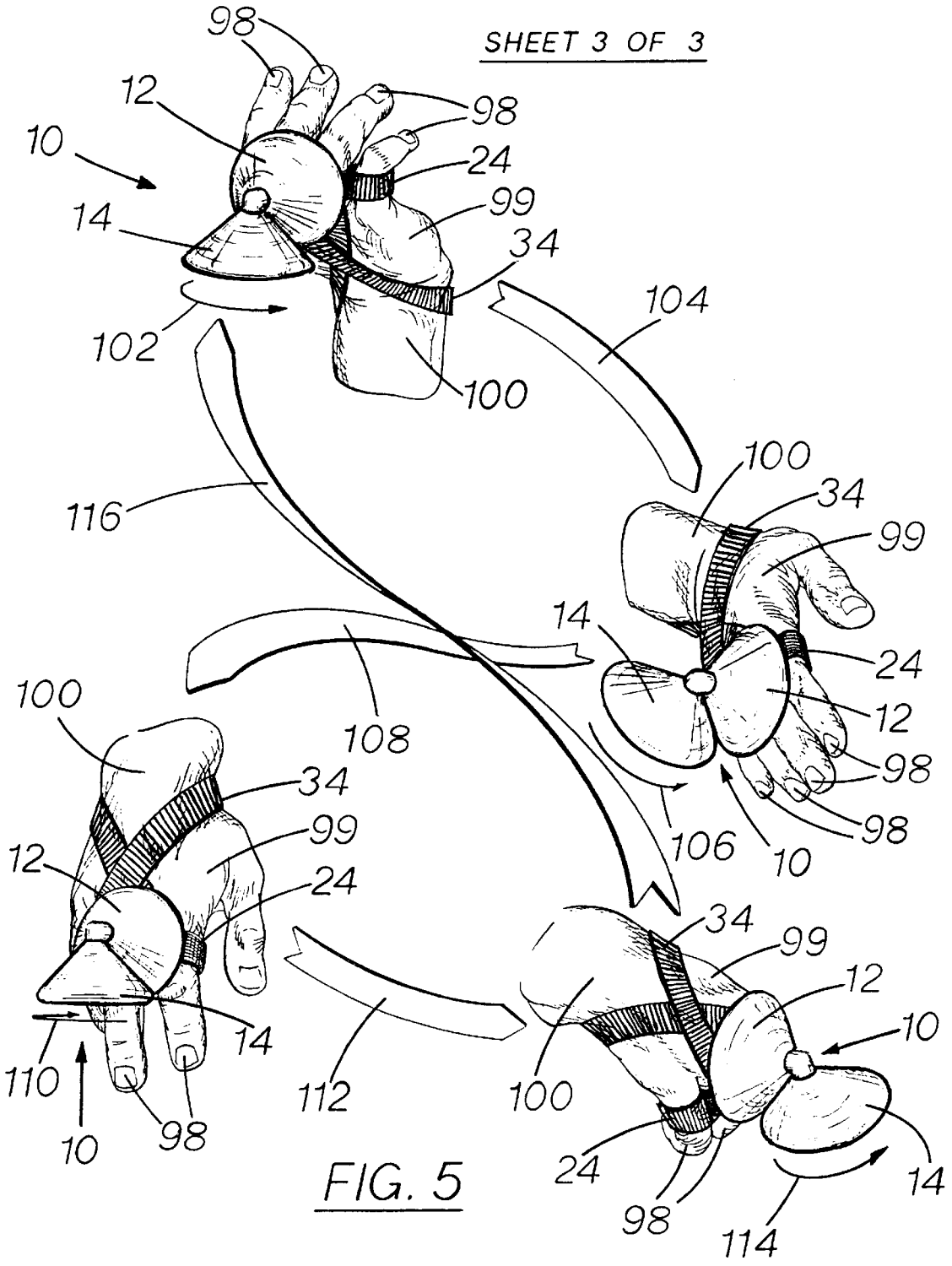
FIG. 5 illustrates a series of perspective views of the subject relaxation/exercise device strapped to the fingers and wrist of a user of the device. The series of drawings illustrate typical hand and wrist movements during an exercise program.

In FIG. 5, a series of perspective views of the relaxation/exercise device 10 are shown with the finger straps 24 received around a portion of fingers 98 of a hand 99 of the user of the device 10. Also, the wrist strap 34 is shown received around a wrist 100 of the user. The drawings in this figure illustrate typical hand and wrist movements during an exercise program. It should be noted that the intended use of the relaxation/exercise device 10 requires operating one unit on each hand, simultaneously. However, in cases where only one hand is able, operating a single unit can also produce favorable results. Only the operation of one unit is shown in FIG. 5.

In these drawings, the first circular base 20 of the first conical shaped wheel 12 is disposed next to the fingers 98. The second conical shaped wheel 14 is free to orbit about the axis of the second pivot shaft 72 as indicated by arrow 102 and shown in the drawing in a first position in the upper left hand corner of FIG. 5.

As the forearm is lowered from the first position and the wrist 100 pronated as indicated by a large arrow 104, the second conical shaped wheel 14 rotates counterclockwise as indicated by arrow 106 on the first conical shaped wheel 12. As the forearm is extended and the wrist 100 flexed as indicated by a large arrow 108, the second conical shaped wheel 14 continues to rotate counterclockwise on the first conical shaped wheel 12 as indicated by arrow 110. The wrist 100 is now fully flexed and also fully pronated as indicated by large arrow 112, and the forearm flexed as the second conical shaped wheel 14 continues its counterclockwise rotation about the first conical shaped wheel 12 as indicated by arrow 114. The forearm is then raised as indicated by the large arrow 116, the wrist 100 extended and supinated as the second conical wheel 14 continues its counterclockwise rotation as the hand held relaxation/exercise device 10 returns to the first position.

It should be noted that the device 10 is centered on the proximal (third) phalanx of each third (middle) finger. The device is directly connected to and engages an axial line of the hands, arms and shoulders. Also, it should be mentioned the axial line refers to a dynamic axis of the body. The axis maintained through muscle coordination and reflex. Through the axial line, each device 10 is connected to the other. The objective is to develop and maintain this connection while practicing balance and proper breathing.

By the arrangements of the finger slots 22, finger strap 24 and wrist strap 34 configurations, each device 10 is mounted on the hand and so held as an extension of the axis mentioned above. The weight of each device 10 orbits the axis eccentrically and at right angles, exerting an angular deflection thereto oriented with gravity. Physically resisting and/or yielding to the angular deflection against the axis, benefits one's coordination of strength, flexibility and balance. This is what makes the subject invention distinctly different from any other exercise device in practice.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A hand held relaxation/exercise device adapted for attachment to a back of a hand, the device comprising:

a first wheel freely rotatable on a first pivot shaft;

a second wheel freely rotatable on a second pivot shaft having one end connected to an end of said first pivot shaft by an elbow, said second wheel rotatably engaging said first rotatable wheel; and means for securing said first rotatable wheel to the back of the hand.

2. The device as described in claim 1 wherein said first wheel includes sloping sides and said second wheel includes sloping sides, the sloping sides of said first wheel disposed next to the sloping sides of said second wheel.

3. The device as described in claim 2 wherein the sloping sides of said first wheel engage and rotate on the sloping sides of the second wheel as said first wheel pivots and rotates on said second wheel when said wheels are rotated during an exercise program.

4. The device as described in claim 1 wherein said first wheel includes a first circular base with sloping sides extending upwardly to an apex and said second wheel includes a second circular base with sloping sides extending upwardly to an apex, said sloping sides of said first wheel engaging and rotating on said sloping sides of said second wheel when said wheels are rotated.

5. The device as described in claim 1 wherein said means for securing is a strap connector attached to said first rotatable wheel, said strap connector receiving a portion of finger and wrist straps thereon for securing said strap connector to fingers and wrist of a user of the device.

6. The device as described in claim 1 further including an accessory weight with fastening means for securing said accessory wheel weight to said second wheel.

7. A hand held relaxation/exercise device adapted for attachment to a back of a hand, the device comprising:

a first conical shaped wheel having a first circular base with sloping sides extending upwardly to an apex, said first wheel freely rotatable on a first pivot shaft;

a second conical shaped wheel having a second circular base with sloping sides extending upwardly to an apex, said second conical shaped wheel freely rotatable on a second pivot shaft having one end connected to an end of said first pivot shaft by an elbow, said second wheel rotatably engaging said first, and a strap connector attached to said first circular base of said first wheel and having straps for securing said strap connector to the back of the hand.

8. The device as described in claim 7 wherein said strap connector includes finger strap slots receiving finger straps therein and a flange receiving a portion of a wrist strap, said finger straps and said wrist strap for securing the device to a user's fingers and wrist during an exercise period.

9. The device as described in claim 7 wherein said first pivot shaft is disposed through the center of said first wheel and rotatably mounted on a first ball bearing mounted inside said first circular base.

10. The device as described in claim 9 wherein said second pivot shaft is disposed through the center of the second wheel and rotatably mounted on a second ball bearing mounted inside said second circular base.

11. The device as described in claim 10 wherein said second pivot shaft extends outwardly from the apex of said second wheel, said second pivot shaft connected to one end of a 90 degree elbow, said first pivot shaft connected on an opposite end of said elbow.

12. The device as described in claim 7 wherein the sloping sides of said second wheel engage the sloping sides of said first wheel and rotate thereon during the use of the device.

13. A hand held relaxation/exercise device adapted for attachment to a back of a hand via strapping to fingers of the hand and wrist, the device comprising:

a first conical shaped wheel having a first circular base with sloping sides extending upwardly to an apex, said first conical shaped wheel including a first pivot shaft disposed through the center of said first wheel and rotatably mounted on a first ball bearing mounted inside said first circular base;

a second conical shaped wheel having a second circular base with sloping sides extending upwardly to an apex, said second conical shaped wheel pivotally mounted on said first conical shaped wheel, said second conical shape wheel including a second pivot shaft disposed through the center of the second wheel and rotatably mounted on a second ball bearing mounted inside said second circular base, the sloping sides of said second wheel engage the sloping sides of said first wheel for rotating thereon during the use of the device;

a 90 degree elbow, said second pivot shaft extending outwardly from the apex of said second wheel, said second pivot shaft connected to one end of said 90 degree elbow, said first pivot shaft extending outwardly from the apex of said first wheel, said first pivot shaft connected on an opposite end of said 90 degree elbow; and a strap connector attached to said first circular base of said first wheel, said strap connector including finger strap slots receiving finger straps therein and a flange receiving a portion of a wrist strap, said finger straps and said wrist strap for securing the device to the fingers of the hand and the wrist during an exercise period.

14. The device as described in claim 13 further including an accessory weight with fastening means for securing said accessory weight to a face of said second circular base of said second wheel.

* * * * *